United States Patent [19]

Schippers et al.

[11] Patent Number: 4,698,959

[45] Date of Patent: Oct. 13, 1987

[54] APPARATUS FOR TWISTING MULTIFILAMENT YARN

[75] Inventors: Heinz Schippers; Peter Dammann, both of Remscheid, Fed. Rep. of Germany

[73] Assignee: Barmag AG, Remscheid, Fed. Rep. of Germany

[21] Appl. No.: 892,067

[22] Filed: Jul. 30, 1986

[30] Foreign Application Priority Data

Aug. 7, 1985 [DE] Fed. Rep. of Germany ..... 3528244
Dec. 10, 1985 [DE] Fed. Rep. of Germany ..... 3543526

[51] Int. Cl.[4] ..... D02G 1/04; D01H 1/241

[52] U.S. Cl. ..... 57/336; 57/105; 57/348

[58] Field of Search ..... 57/104, 105, 331, 334, 57/336, 348, 349

[56] References Cited

U.S. PATENT DOCUMENTS

| | | | |
|---|---|---|---|
| 2,908,133 | 10/1959 | Brown | 57/336 |
| 3,045,416 | 7/1962 | Ubbelohde | 57/336 X |
| 3,103,097 | 9/1963 | Meili et al. | 57/336 |
| 4,047,373 | 9/1977 | Takai | 57/336 |
| 4,144,700 | 3/1979 | Takai et al. | 57/336 X |
| 4,144,701 | 3/1979 | Takai et al. | 57/336 |
| 4,296,598 | 10/1981 | Faure | 57/336 X |
| 4,377,932 | 3/1983 | Dammann et al. | 57/336 |
| 4,566,265 | 1/1986 | Naylor | 57/336 |

FOREIGN PATENT DOCUMENTS

| | | |
|---|---|---|
| 278535 | 1/1952 | Switzerland . |
| 986245 | 3/1965 | United Kingdom . |
| 1083052 | 9/1967 | United Kingdom . |

*Primary Examiner*—John Petrakes
*Attorney, Agent, or Firm*—Bell, Seltzer, Park & Gibson

[57] ABSTRACT

A yarn twisting apparatus is disclosed wherein a single endless belt is entrained upon first and second roller means. At least one of the roller means is rotatably driven, so that the belt segments which extend between the roller means cross in opposing face-to-face relation at a location between the roller means and so as to define a twisting zone therebetween, and a running yarn is guided through the twisting zone so as to have twist imparted thereto. In a preferred embodiment, one of the roller means comprises a pair of individual rollers which are selectively movable to permit adjustment of their lateral separation, and which in turn permits adjustment of the crossing angle of the belt segments and thus the amount of twist imparted to the running yarn. Also, the pair of rollers are preferably mounted by an arrangement which permits the pivoting of the rollers about a transverse axis which extends through the twisting zone, to thereby permit the belt segments to be separated at the twisting zone and thus facilitate yarn threadup.

15 Claims, 11 Drawing Figures

APPARATUS FOR TWISTING MULTIFILAMENT YARN

BACKGROUND OF THE INVENTION

The present invention relates to an apparatus for twisting or false twisting multifilament yarns, of the type comprising an endless, flat belt, which is entrained about a number of rollers so that the belt crosses itself at a point with a substantially rectangular cross section to define a twisting zone. A running yarn is guided through the twisting zone and between the belt segments so that a twist is imparted to the yarn.

It is known to guide a running yarn across surfaces which are moved transversely to the yarn path for the purpose of imparting temporary or permanent twist to the yarn, and this procedure permits high yarn speeds and a sufficient level of twist density, since the frictional contact between the surface and the yarn serves to impart a desired twist to the yarn. Known from the art is a type of apparatus in which the yarn is guided between two belts or belt segments which cross each other and move in opposite directions to thereby impart twist to the running yarn and, at the same time, a conveying component is imparted of a magnitude which is dependent on the crossing angle of the belts or belt segments.

Two different forms of apparatus of the described type are known. In one, two endless belts are moved against each other at a crossing angle which is adjustable with the yarn being guided in the crossing area between the two belts. Examples of such apparatus can be found in Swiss Pat. No. 278,535, British Pat. No. 1,083,052, U.S. Pat. No. 4,144,700, and others. However, these prior designs have several disadvantages. For example, it is known that a belt cannot transmit transverse forces without deflection unless auxiliary support means is provided, even under a very high belt tension. For this reason, it will not suffice to simply guide the belts across each other, and the first-mentioned prior art publication thus provides for contact pressure rolls on the backside on both sides of the yarn path, whereas British No. 1,083,052 suggests that one of the two belts be provided with ferrogmagnetic properties and that, in the area of the yarn passage, a magnet be arranged on the backside of the opposite belt. However, neither of these two suggestions has been found to be satisfactory.

In a second form of prior apparatus, only one endless belt is used, which is guided over two rolls so that it crosses between the rolls. This crossing, which is accomplished in that one half of the belt loop is twisted relative to the other by about 180°, or even somewhat more if necessary, makes the two belt segments which move against each other in the crossing area contact in such a manner that a twist is imparted to the yarn which is guided between them. U.S. Pat. Nos. 2,908,133, 4,566,265, and British Pat. No. 986,245, disclose apparatus of this type.

This second type of apparatus makes it possible to impart a twist to the yarn. since the belt segments contacting each other in the crossing area, detorm each other. However, the ettectiveness is limited, since the belt crossing angle and thus the amount of twist imparted to the yarn cannot be readily adjusted, and the insertion of the yarn between the crossing belts sections is very burdensome and time consuming.

In addition, only the inner belt surface is used because of the type of belt guidance, and this can lead to changes in the frictional contact between the belt and the yarn, and to uncontrolled drive slippage, by reason of a soiled belt surface resulting from yarn deposits or the like.

Accordingly, it is an object of the present invention to provide an apparatus for twisting a running yarn which overcomes the disadvantages and limitations of the prior art as noted above.

It is also an object of the present invention to provide a twisting apparatus of the type employing a single crossed endless belt, and which provides for the ready adjustment of the belt crossing angle to thereby permit adjustment of the amount of twist imparted to the yarn.

It is a further object to provide an apparatus of the described type, and which has improved contact between the yarn and the belt, which provides for a simple and fast insertion of the yarn, and which may be configured so that both belt sides are used as much as possible.

SUMMARY OF THE INVENTION

These and other objects and advantages of the present invention are achieved in the embodiments illustrated herein by the provision of a yarn twisting apparatus which comprises first and second longitudinally spaced apart roller means, and means mounting the first and second roller means for rotation about respective axes. An endless belt is entrained about the first and second roller means, and so as to define belt segments extending between the roller means and with the belt segments crossing in opposing face-to-face relation at a location between the roller means and so as to define a twisting zone therebetween. Drive means is provided for rotating the roller means and such that the belt segments run in different directions through the twisting zone, and a running yarn is guided through the twisting zone so as to have twist imparted thereto by frictional contact between the yarn and the opposing belt segments. Further, and in accordance with one aspect of the present invention, the first roller means comprises a pair of separate laterally spaced apart rollers, and the pair of rollers are mounted for rotation about respective parallel axes and such that the lateral separation between the axes may be selectively adjusted so as to permit an adjustment of the crossing angle of the belt segments and thus the amount of the twist imparted to the yarn.

In another preferred embodiment, the pair of rollers of the first roller means are also mounted so that the pair of rollers may be adjustably pivoted about an axis which is substantially perpendicular to the axes of rotation of the pair of rollers, and which also extends through the twisting zone, to thereby permit the belt segments to be separated at the twisting zone and thus facilitate threadup. Also, it is preferred that the pair of rollers of the first roller means are each mounted to a fixed support member, by means of a pair of brackets mounting respective ones of the rollers and with the brackets being disposed on respective opposite sides of the rollers, and such that a yarn may be threaded laterally between the rollers and to a position between the belt segments at the twisting zone.

In another specific embodiment, the first roller means comprises a first pair of laterally separated rollers, and the second roller means comprises a second pair of longitudinally aligned rollers. The endless belt is guided in two elongate loops over the several rollers, and with the belt looping around the roller of the second roller means which is closest to the twisting zone, and then being spread by the two rollers of the first roller means into a generally W-shape. In another embodiment, the belt is guided into a W-shaped and runs over a total of five rollers, of which four are disposed in the corners of a rectangle surrounding a center roller, and with the four corner rollers being preferably jointly or separately adjustable in their position relative to each other. An additional tensioning roller may also be provided for maintaining a desired tension in the belt.

The apparatus of the present invention may also include belt guide means in the area of the twisting zone, which supports the belt segments so that they lie in two parallel planes. The belt guide means may be stationary and immobile, and take the form of rods on both sides of the twisting zone, or they may be in the form of a plate which extends along the belt path across the twisting zone. In one specific embodiment, the belt guide means presses the two facing flat surfaces of the belt segments against each other, preferably with a resilient force, in the area of the twisting zone. Also, the belt guide means may be disposed before and after the twisting zone, and biasing means may be positioned in the crossing area of the yarn passage, and preferably such biasing means is limited to the area of the yarn passing through the twisting zone. To reduce friction between the biasing means and the belt, known friction reducing means may be used, such as a low friction coating and/or the generation of a thin film of fluid or air. The biasing means is not rigid, and its cooperating members are adapted to move resiliently toward each other. In this regard, it will suffice if one member is resiliently movable and the cooperating member is fixed.

The present invention permits the junctions of the two sides of the endless belt to be separated, so that one side contacts the yarn and the other side contacts the rollers. To this end, a belt may be used which has the shape of a doubled Mobius strip, and which is obtained when a Mobius strip is cut along its center line. A Mobius strip is described in "Meyers Grosses Taschenlexikon", Edition 1983, pp. 317–318, or "The Encyclopedia Americana", Copyright 1972, Vol. 26, p. 854; "The Mobius Strip" and it is created when the opposite, narrow sides of an elongated strip are so joined with each other that the previously diagonally opposed corners coincide, which results in a single, continuous surface extending in its longitudinal direction. The doubled Mobius strip can also be obtained by a procedure wherein before joining the two ends of an open strip section, these ends are twisted relative each other by 720°. To obtain a Mobius strip, it will suffice to twist the ends of the open strip by 180°.

BRIEF DESCRIPTION OF THE DRAWINGS

Some of the objects and advantages of the present invention having been stated, others will become apparent as the description proceeds, when considered in conjunction with the accompanying schematic drawings, in which—

DETAILED DESCRIPTION OF THE PREFERRED EMBODIMENTS

Figure 1:
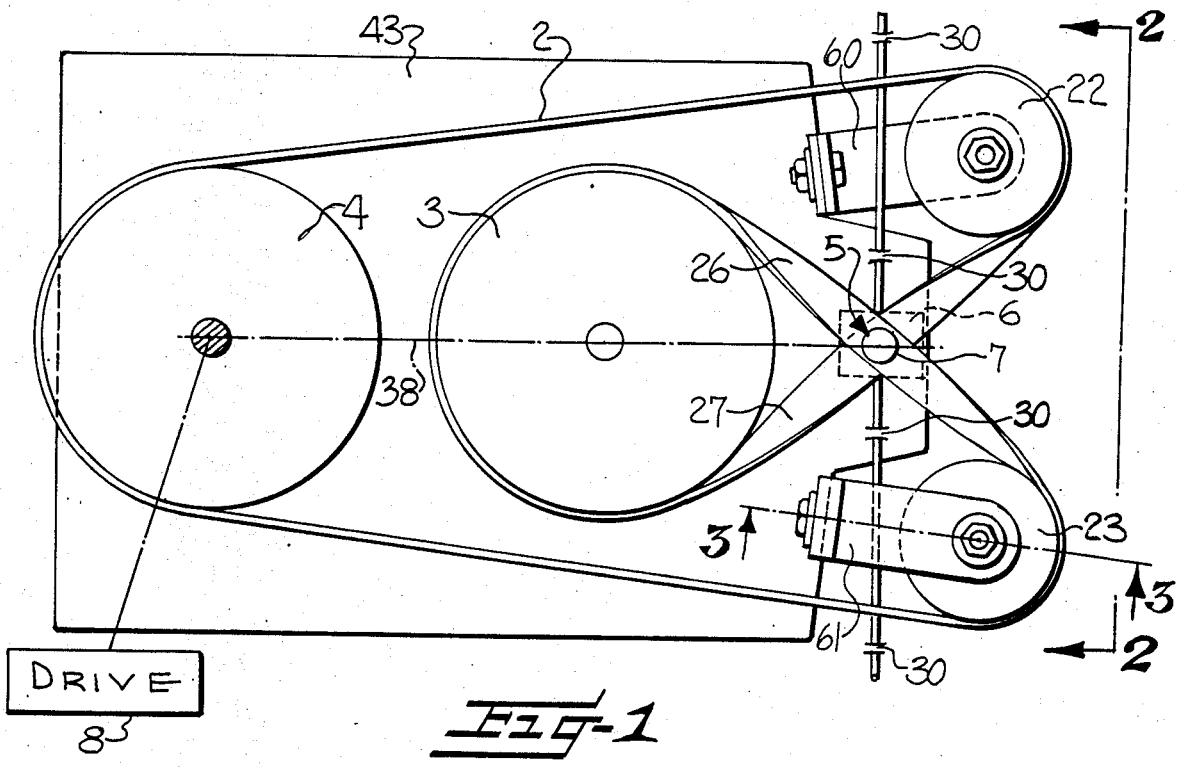
FIG. 1 is a side elevation view of a twisting apparatus which embodies the present invention, and which employs a total of four rollers and a standard belt.
Figure 2:
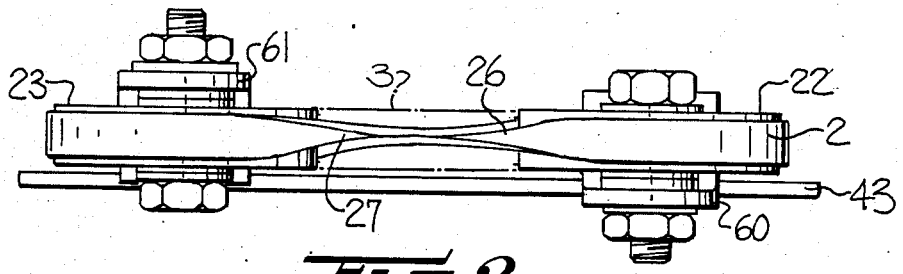
FIG. 2 is an end elevation view taken along the line 2—2 of FIG. 1.

Referring more particularly to the drawings, FIGS. 1–4 illustrate a yarn twisting apparatus which incorporates the features of the present invention. The apparatus of this embodiment comprises first and second longitudinally spaced apart roller means, with the first roller means taking the form of a first pair of laterally spaced apart rollers 22, 23, which are mounted for rotation about parallel axes as further described below. The second roller means, which is positioned on the opposite side of the twisting zone 5 from the rollers 22, 23, takes the form of a second pair of rollers, namely a center roller 3 and an outer roller 4, which are rotatably mounted in alignment along a longitudinal axis 38 of the apparatus which extends through the twisting zone 5 and which perpendicularly bisects a line extending between the axes of the rollers 22, 23. Also in this embodiment, the roller 4 is rotatably driven by a conventional drive, which is indicated at 8.

An endless belt 2 is entrained about the roller means and so as to define belt segments 26, 27 which extend between the roller means, and with the belt segments crossing in opposing face-to-face relation at a location between the roller means and so as to define the twisting zone 5 therebetween. The belt may be entrained about the rollers by a procedure, for example, wherein the belt is looped around the roller 3, then twisted about 180° in the counterclockwise direction to form a pair of loops, which are then looped around the rollers 22, 23, and 4. When the belt is in the illustrated position, operation of the drive 8 acts to rotate the rollers, and such that the belt segments 26, 27 run in different directions through the twisting zone 5.

The apparatus may also include guides 30 for guiding a running yarn 1 through the twisting zone 5, and so that twist is imparted to the yarn by the frictional contact between the yarn and the opposing belt segments.

Figure 3:
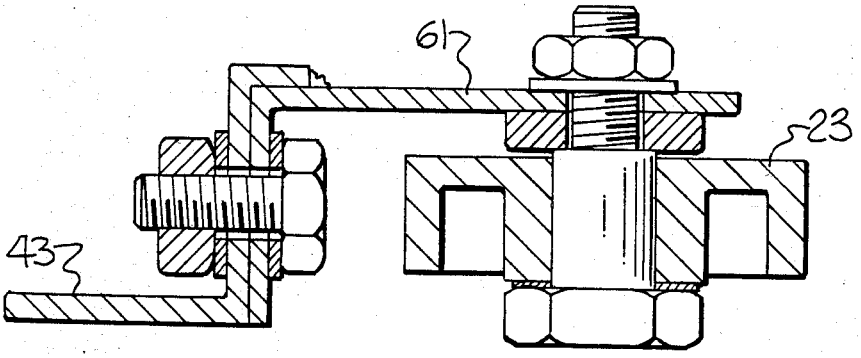
FIG. 3 is a fragmentary sectional view taken substantially along the line 3—3 of FIG. 1.
Figure 4:
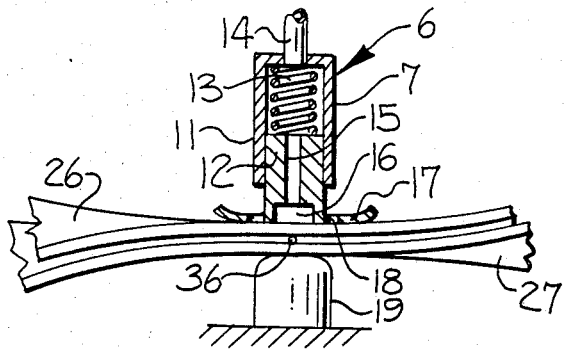
FIG. 4 is a fragmentary sectional view of the crossing area of the endless belts, and illustrating the belt smoothing and biasing means.

As best seen in FIG. 4, belt guide means 6 is provided which is mounted adjacent the twisting zone 5, and which includes a smoothing plate 17, and biasing means 7 for locally biasing the belt segments 26, 27 toward each other at the twisting zone 5. The biasing means 7 comprises a movable piston 12 and a fixed piston 19 which operate against each other. The plate 17 extends across the entire crossing area of the twisting zone 5, and it includes an opening 18 which is concentric to the twisting point 36 at which the yarn 1 is located. The piston 12 extends through the opening 18, and rests upon the belt segment 26. The diameter of the opening 18 is dimensioned so that contact between its edge and the piston 12 is avoided, and the piston 12 moves in a guide cylinder 11, so as to be movable perpendicularly to the surface of the segment 26. The counter piston 19 is fixedly mounted on the other side of the belt segments, and it engages the surface of the belt segment 27. The piston 12 is biased by a spring 13 in the downward direction as illustrated in FIG. 3, and is supported by the counter piston 19. Rather than the use of a spring 13, a cylinder piston assembly may also be employed, in which case the piston 12 is operated by the action of compressed air rather than the spring 13. For this purpose, an air line connection 14 is provided on the cylinder 11.

A central passage 15 extends through the piston 12, which terminates in a widened portion 16 at the end of the piston engaging the belt segment 26. When a spring loaded piston 12 is employed, the passage 15 serves to build up a coating of a fluid in the form of a lubricating film between the piston 12 and belt surface, which is produced by the compressed air supplied via the connection 14. While not illustrated, it will be understood that a similar lubrication system may be provided for the piston 19. With the use of a cylinder piston assembly, the connection 14 serves to supply the air which biases the back side of the piston 12, and the passage 15 will then serve as a throttle, which is dimensioned so that the build up of the lubricating film does not jeopardize the function of the cylinder piston assembly.

The smoothing plate 17 and the biasing means 7 may also be spaced apart from each other further than that shown in FIG. 4, and so as that only the pistons 12 and 19 are located directly in the area of the yarn contacting point 36. In such case, the smoothing plate may be provided in the belt path both before and after the twisting zone 5. In so doing, it may be desirable to provide a smoothing plate for each belt segment 26, 27, both before and after the twisting zone 5.

As can be seen in the drawings, each of the two crossing segments 26 and 27 of the belt 21, twists upon itself by 180°, as it leaves roller 3 and runs up to the opposite roller, whereby the different function of the two belt sides comes about. Aside from the fact that this prevents problems relating to the contamination of the belt as noted above, there exists the possibility of specially preparing each belt side corresponding to its respective function.

It will also be noted that the embodiments of FIGS. 1–6 are equipped with different types of belts. The belt 2 (FIG. 1) or 21 (FIG. 5) or 24 (FIG. 6) is guided in two elongate loops. One of the loops extends from the outer roller 4 via roller 22 to the center roller 3, and the other loop extends from roller 3 via roller 23 to the roller 4. The loops are both guided around the common center roller 3, and thus the loop sections are spread into a generally W-shape. The belt 2 of FIG. 1 runs from the roller 22, via roller 4, to the roller 23 without being twisted, and is then twisted by 180° in the counterclockwise direction, before it contacts the roller 3, so that the twisting zone 5 is formed by the above described loops and their W-shaped spreading. The smoothing and biasing means are indicated only schematically in FIG. 1. The above arrangement results in a more uniform use of the belt surfaces, in that one surface contacts the center roll 3 and the yarn, while the other belt surface contacts the rollers 22, 4, and 23. This will not change when the belt loop guided over the roller 3 is rotated to change the direction of the twist in the manner described below.

Figure 5:
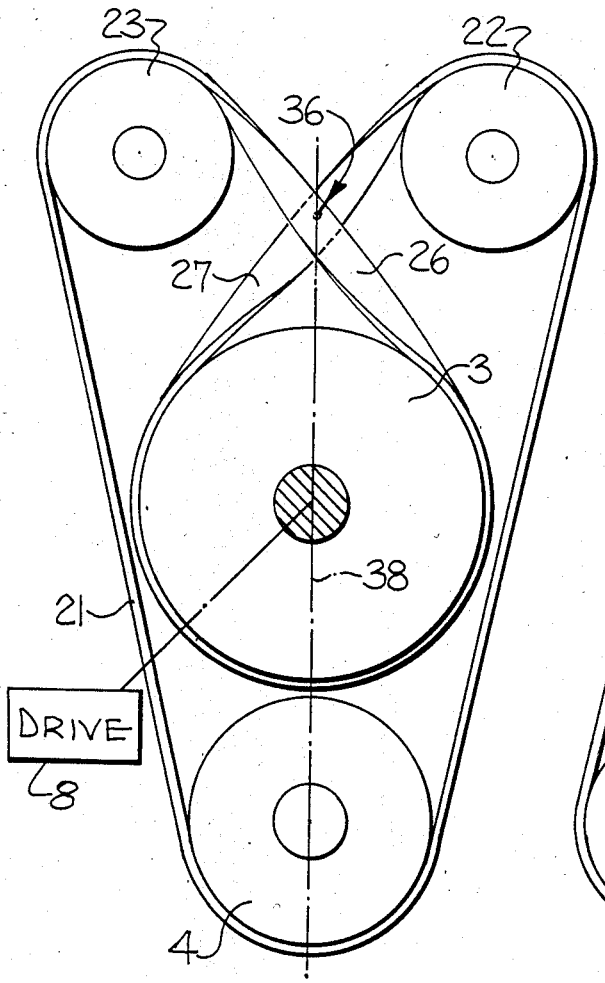
FIG. 5 is a view similar to FIG. 1, but wherein the apparatus uses a doubled Mobius strip.

The embodiment of FIG. 5 is provided with a belt in the form of a doubled Mobius strip 21. The belt contacts with one surface the center roll 3, which serves as the drive roll in this embodiment, whereas the other surface contacts the yarn 1 and the driven rollers 22, 23, and 4, so that the separation between the drive side and the yarn contacting side prevents the surface of the drive side from being affected by yarn deposits, yarn preparation, and the like.

Figure 6:
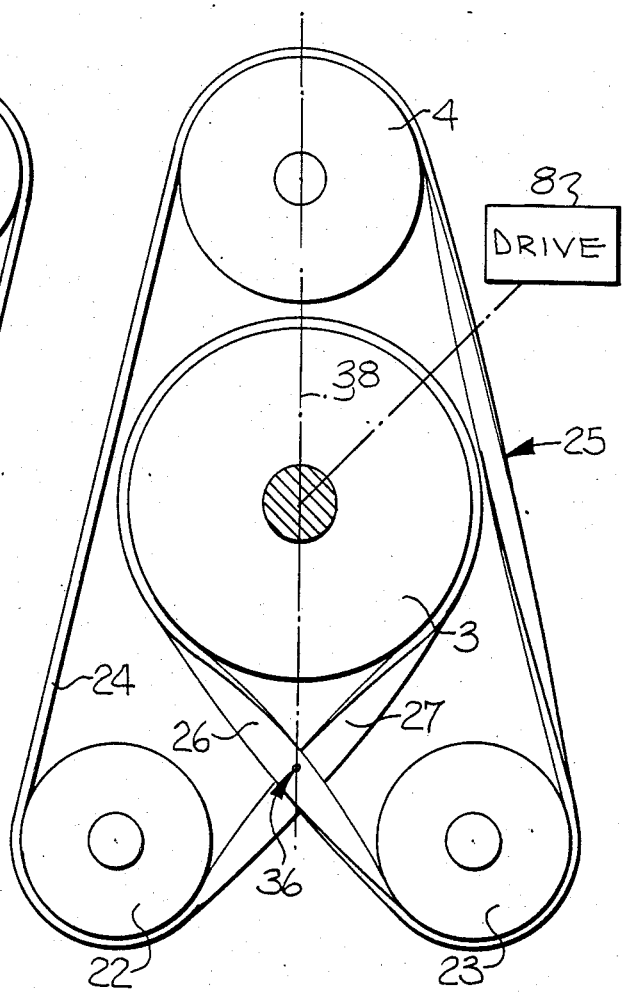
FIG. 6 is a view similar to FIG. 1, using a Mobius strip.

In FIG. 6, the belt 24 has the form of a true Mobius strip. While the crossing area does not differ from that of FIG. 5, the required guidance in the twisting zone 5 requires that an additional twist 25 be provided between the two rollers 4 and 23 as illustrated, or between the rollers 4 and 22 (not shown). However, by definition the Mobius strip has only one operative surface, the result is a more uniform use of such surface. This particular feature of the Mobius strip 24 makes it possible to keep the belt surface clean by positioning a single cleaning device, if necessary.

As noted above, the embodiments of FIGS. 1–6 illustrate the second roller means as comprising a pair of rollers 3,4. In a simplified arrangement which is not illustrated, the roller 4 may be omitted, and the belt 2, 21, or 24 may be guided twice over the center roller 3. As a result, the belt length may be substantially shortened. The belt segments may overlie each other on the center roll 3, however, depending on the thickness and material of the belt, the differences in the drive speed caused by the difference radial distances of the two overlying belt segments from the axis of the center roll 3 may lead to a noticeable impairment of the function, or the impairment may be negligible. This problem may be circumvented, by guiding the belt sections next to each other over an axially extended roller 3.

In the embodiment of FIG. 1, the two rollers 22, 23 are rotatably mounted to a fixed support member 43, by means of a pair of brackets 60,61. The brackets are disposed on respective opposite sides of the rollers, such that a yarn may be threaded laterally between the rollers and to a position between the belt segments at the twisting zone. In this regard, it will also be noted that the respective brackets 60,61 are on the sides of the twisting zone 5, on which the associated belt sections 26 or 27 are positioned. Thus as illustrated, the bracket 60 of the roll 22 is located below the roller 22, and the associated belt segment 27 is below the twisting zone, and the bracket 61 of the roll 23 is above the roller and the associated segment 26 is on the upper side of the twisting zone. This same arrangement is illustrated schematically in FIGS. 5 and 6.

The yarn guides 30 as illustrated in FIG. 1 guide the advancing yarn 1 through the twisting zone 5, and support the yarn in the plane defined between the belt segments in the twisting zone, to thereby stabilize the yarn as it is twisted.

Referring again to the embodiments of FIGS. 1–6, it is possible to change the direction of twist imparted to the yarn 1 without changing the direction of the drive, by connecting the drive to the roller 4, and mounting the roller 3 for rotation by 360° about an axis which is perpendicular to its rotational axis and extends along a line which bisects a connection between the centers of the two rollers 22 and 23. Such axis of rotation can coincide with the longitudinal axis 38 of the apparatus as defined above.

Figure 7:
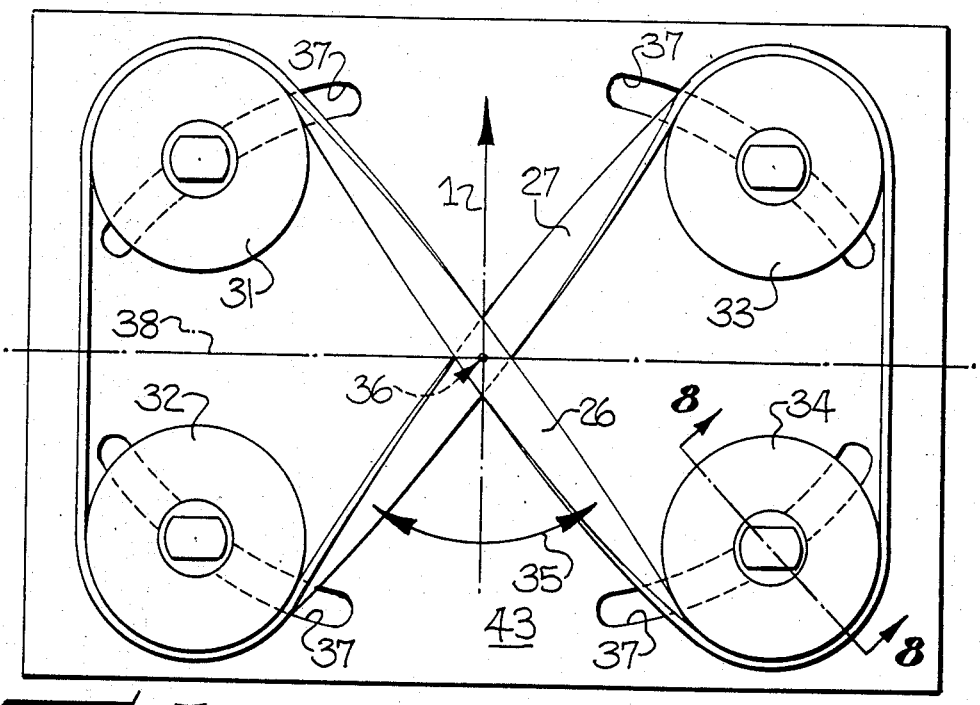
FIG. 7 is a side elevation view of a further embodiment of the present invention, and which also utilizes a total of four rollers.
Figure 8:
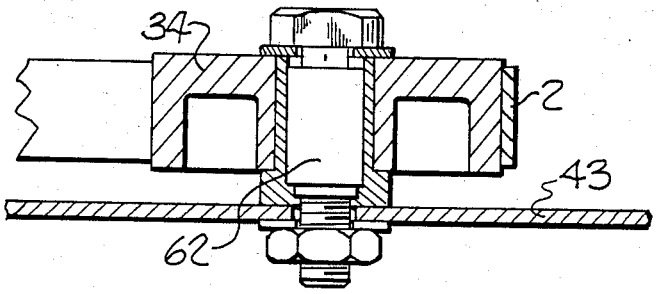
FIG. 8 is a sectional view taken substantially along the line 8—8 of FIG. 7.
Figure 10:
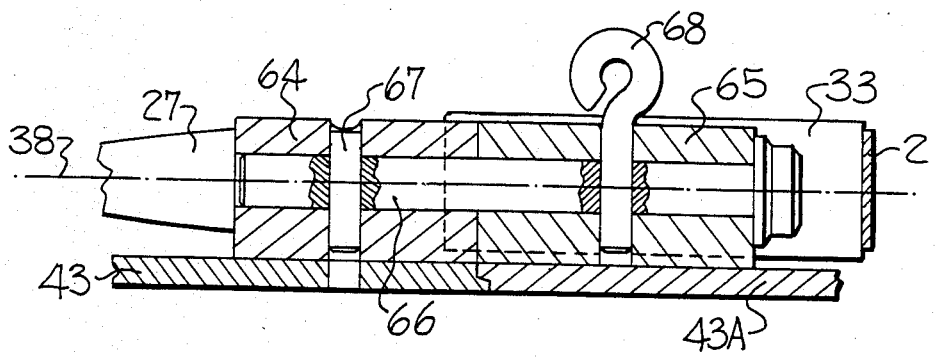
FIG. 10 is a sectional view taken substantially along the line 10—10 of FIG. 9.

When processing yarns with different deniers, and/or different filament deniers, or of different materials, it has been found desirable to mount the rollers of at least one of the roller means so as to permit the selective adjustment of the lateral separation between their mounting axes and so as to permit an adjustment of the crossing angle of the belt segments and thus the amount of the twist imparted to the yarn. This arrangement is illustrated in the embodiment of FIGS. 7–8, and wherein the first roller means is in the form of a first pair of spaced apart rollers 31, 32 on one side of the twisting zone, and the second roller means in the form of a pair of rollers 33, 34 on the other side of the twisting zone. All of the rollers 31–34 are mounted on a fixed supporting plate 43, by means of an arcuate slot 37 in the plate and a bearing and supporting bolt 62 as seen in FIG. 10. As will be apparent, each of these rollers may be adjusted along the associated arcuate slot by loosening the bolt, sliding the roller to the desired position, and then re-tightening the bolt. Also, such adjustment can be effected while maintaining the same belt length.

Figure 9:
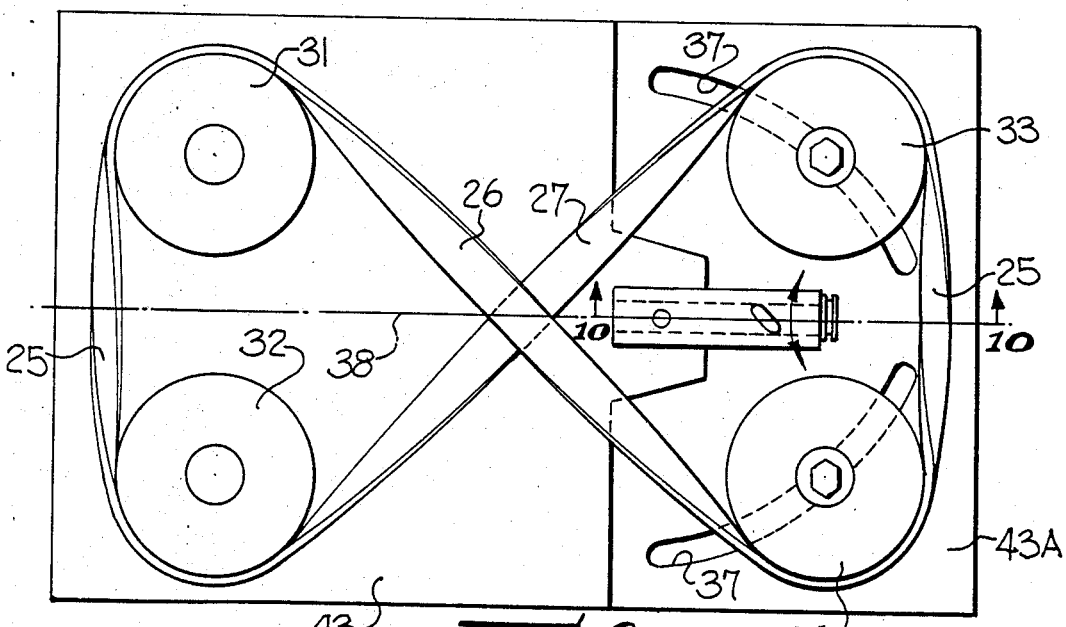
FIG. 9 is a view similar to FIG. 7, with the belt being further twisted.

FIGS. 9–10 illustrate an embodiment which includes means for adjustably pivoting the rollers 33, 34 about the axis 38, which is substantially perpendicular to the axes of rotation of the rollers 33, 34 and which extends through the twisting zone 5. This pivotal adjustment permits the belt segments 26, 27 to be separated at the twisting zone, to thereby facilitate yarn threadup. As best seen in FIG. 10, the rollers 33, 34 are mounted on a plate segment 43A, which is positioned adjacent the fixed plate 43. Also, the plate segment 43A and plate 43 mount aligned sleeve sections 64,65 having a pin 66 extending axially therethrough. The pin 66 is locked to the segment 64 by means of a cross pin 67, and may be selectively locked to the segment 65 by the removable cross pin 68. As will be apparent, removal of the pin 68 permits the plate segment 43A to rotate about the axis of the pin 66, which is coincident with the axis 38. To change the direction of the twist imparted to the yarn 1, the plate 43A and rollers 33, 34 may be rotated by 180°, and then locked in such position by the insertion of the cross pin 68.

The pivotal mounting of the rollers 33, 34 about the axis 38 as seen in FIGS. 9 and 10 not only permits the opening of the twisting zone to facilitate yarn threadup, but in addition, the angular contact of the belt segments 26, 27 at the twisting zone can be increased, which may permit the smoothing plate and biasing pressure means to be either eliminated entirely, or limited to one side of the belts. In so doing, the required belt length should not change, to the extent possible. However, a resilient belt tensioning device, such as shown at 42 in FIG. 11, can under certain circumstances compensate for small variations in the length of the looped path of the belt.

In the embodiments shown in FIGS. 7 and 9, the belt is guided in the form of a figure eight, and the two pairs ot rollers 31, 32 and 33, 34, are arranged in a rectangular pattern. In FIG. 7, all of these rollers are movable along the arcuate mounting slots 37, so as to permit the crossing angle 35 to change within a wide range, and the belt tension and length may be maintained. In the embodiment of FIG. 9, only the rollers 33, 34 are so adjustable, which also permits an effective adjustment of the crossing angle.

Another advantage results from the use of four rollers, namely, both belt surfaces may be used to the same extent, as shown in FIG. 9. This is accomplished in that the belt 2 is twisted upon itself by 180°, not only in the twisting zone 5, but also at 25 between the rollers 31 and 32 and between the rollers 33 and 34. The respective direction of the twist for one embodiment can be seen in FIG. 9. When viewed in the direction of the belt path, each of the two twists 25 between the rollers has the same direction of twist as that of the belt segment 26, whereas the belt segment 27 is twisted in the opposite direction. However, in another embodiment which is not shown, the belt segments may be twisted in alternating fashion one after another in the direction of the belt path i.e. alternating clockwise and counterclockwise twists of approximately 180°. For example, assuming the belt 2 runs in a direction from the roller 31 to the roller 34, and is twisted in this area to the left, then it is twisted to the right between rollers 34 and 33, again to the left between rollers 33 and 32, and finally to the right between rollers 32 and 31. Furthermore, the belt can be twisted upon itself between the rollers in such a manner that the belt segments 26 and 27 and one of the two twists 25 have the same twist, whereas only the other twist 25 is twisted in the opposite direction. In all three cases, both belt sides are used, although in a somewhat different manner.

Figure 11:
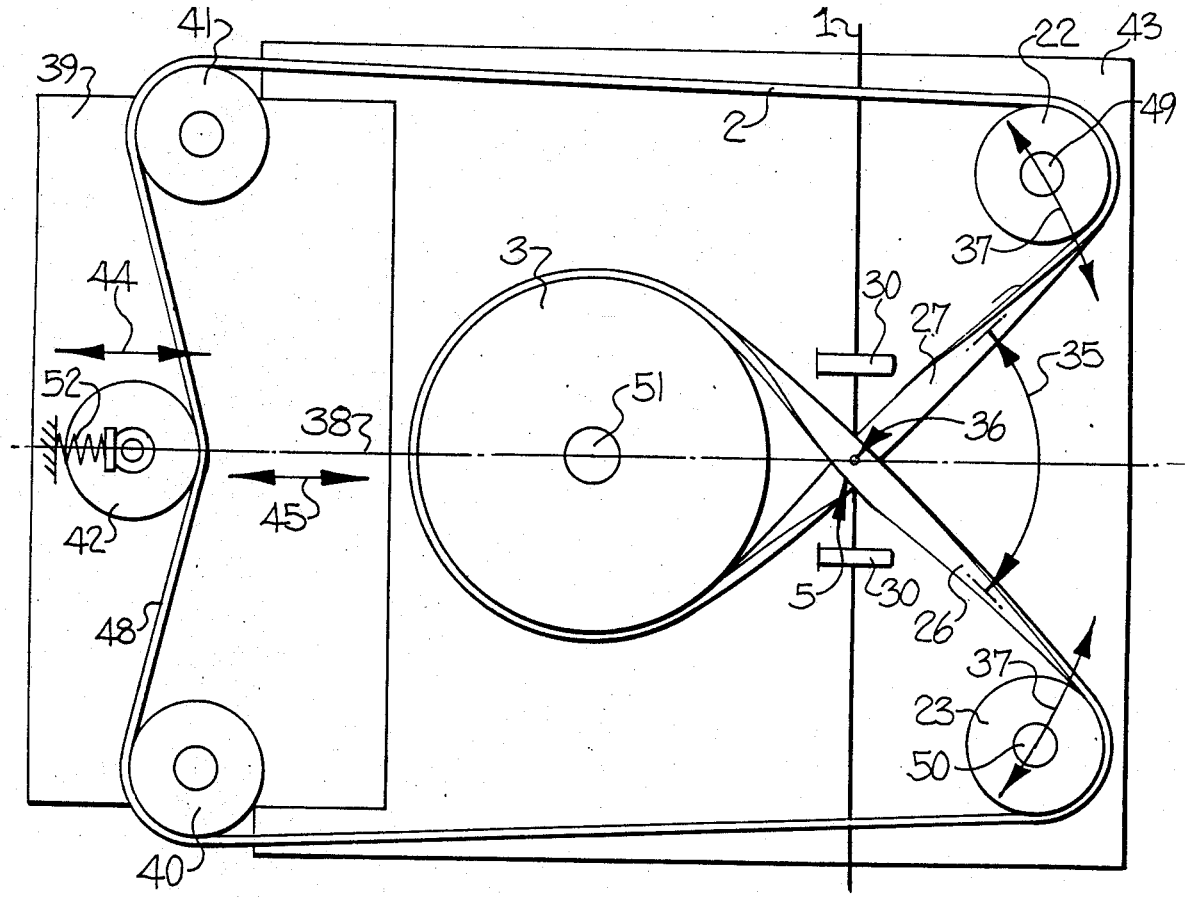
FIG. 11 is a side elevation view of another embodiment of a yarn twisting apparatus in accordance with the present invention, and which employs tour deflecting rollers and a tension applying roller.

FIG. 11 illustrates another preferred embodiment of the apparatus. In this embodiment, the center roller 3 is rotatably mounted on a support plate 43, together with the two rollers 22 and 23. The roller 3, which preferably is the driven roller, is mounted for rotatation about a fixed axis with respect to the plate 43, whereas the position of the rollers 22 and 23 may be varied along the direction of the slots 37 in the manner described above. It is preferred that the two rollers 22 and 23 be symmetrically located with respect to the axis 38 of the apparatus and which serves as the axis of symmetry. The two additional deflecting rollers 40 and 41 are located on the other side of the center roller 3 and are mounted on a slide 39 which can be moved relative to the plate 43 in the direction indicated by the arrow 45. When changing the crossing angle 35, the possible variations of the belt path caused by the repositioning of the rollers 22 and 23 can be compensated for by the repositioning of the slide 39.

A tension roller 42 is also mounted on the slide 39, and is positioned to engage the outside of the belt section 48 which is between the rollers 40 and 41. The roller 42 is mounted for resilient movement by means of a spring 52 in the direction of the arrow 44. Alternatively, a pneumatic cylinder-piston assembly may be employed for this purpose. The tension roller 42 can also be employed in the embodiments of FIGS. 1–6, in which case the outer roller 4 will be replaced by two deflecting rollers 40 and 41 as shown in FIG. 11.

The two deflecting rolls 22 and 23 can also be mounted either jointly or individually, on a slide which for example is movable in a direction parallel to the axis 38. The slides may also be designed so that they are movable symmetrically to the longitudinal axis 38 and at an acute angle with respect thereto.

In the drawings and specification, there has been set forth a preferred embodiment of the invention, and although specific terms are employed, they are used in a generic and descriptive sense only and not for purposes of limitation.

That which we claim is:

1. An apparatus for imparting twist to a running yarn and comprising first and second longitudinally spaced apart roller means, with said first roller means comprising a first pair of laterally spaced apart rollers, means mounting said first and second roller means for rotation about respective axes, and including means for rotatably mounting said first pair of rollers for rotation about respective parallel axis and so as to permit selective adjustment of the lateral separation between said axes, an endless belt entrained about said first and second roller means, and so as to define belt segments extending between the roller means and with the belt segments crossing in opposing face-to-face relation at a location between the roller means and so as to define a twisting zone therebetween, and with said belt segments directly engaging respective ones of said first pair of rollers, drive means operatively connected to at least one of said roller means for rotating the same, and such that said belt segments run in different directions through said twisting zone, means for guiding a running yarn through said twisting zone so as tohave twist imparted thereto by frictional contact between the yarn and opposing belt segments, and whereby the crossing angle of said belt segments at said twisting zone and thus the amount of the twist imparted to the yarn may be adjusted by adjusting the lateral separation of the axes of said first pair of rollers.

2. The apparatus as defined in claim 1 wherein said means mounting said first pair of rollers further includes means for adjustably pivoting said rollers about an axis which is substantially perpendicular to the axes of rotation of said first pair of rollers and which extends through said twisting zone, to thereby permit the belt segments to be separated at said twisting zone and thereby facilitate yarn threadup.

3. The apparatus as defined in claim 1 wherein said means mounting said first pair of rollers comprises a fixed support member, and a pair of brackets mounting respective ones of said first pair of rollers to said support member, and with said brackets being disposed on respective opposite sides of said first pair of rollers such that a yarn may be threaded laterally between said first pair of rollers and to a position between said belt segments at said twisting zone.

4. The apparatus as defined in claim 1 wherein said second roller means comprises a second pair of laterally spaced apart rollers, and said means mounting said roller means includes means for rotatably mounting said second pair of rollers for rotation about respective parallel axes and so as to permit selective adjustment of the lateral separation between said mounting axes of said second pair of rollers and thereby permit a further adjustment of the crossing angle of said belt segments and thus the amount of the twist imparted to the yarn.

5. The apparatus as defined in claim 1 wherein said second roller means comprises a center roller disposed adjacent said twisting zone and an outer roller disposed on the side of said center roller opposite said twisting zone, and wherein said endless belt loops around said center roller, around one of said rollers of said first pair of rollers, around said outer roller, around the other of said rollers of said first pair of rollers, and back to said center roller.

6. The apparatus as defined in claim 1 wherein said second roller means comprises a second pair of rollers which are mounted for rotation about parallel axes, and with the rollers of the first and second pairs being in a generally rectangular arrangement.

7. The apparatus as defined in claim 1 wherein said second roller means comprises a center roller disposed adjacent said twisting zone and an outer pair ot rollers disposed on the side of said center roller opposite said twisting zone, and such that said first pair of rollers and said outer pair of rollers are disposed in a generally rectangular arrangement, and wherein said endless belt loops around said center roller, around one of said rollers of said first pair of rollers, around said outer pair of rollers, around the other of said rollers of said first pair of rollers, and back to said center roller.

8. The apparatus as defined in claim 7 further comprising a tensioning roller, and means resiliently mounting said tensioning roller so as to resiliently contact and tighten said endless belt.

9. The apparatus as defined in claim 1 wherein said endless belt has the form of a doubled Mobius strip.

10. The apparatus as defined in claim 1 further comprising belt guide means mounted adjacent said twisting zone for supporting the belt segments in two parallel planes as they move through said twisting zone.

11. The apparatus as defined in claim 10 wherein said belt guide means comprises at least one flat plate fixedly mounted on the outside surface of one of said belt segments at said twisting zone.

12. The apparatus as defined in claim 10 wherein said belt guide means includes means for locally biasing said belt segments toward each other at said twisting zone.

13. The apparatus as defined in claim 12 wherein said biasing means includes a pressure applying member positioned to act upon the outside surface of one of said belt segments, and a fixed backup member disposed to engage the outside surface of the other of said belt segments.

14. An apparatus for imparting twist to a running yarn and comprising first and second longitudinally spaced apart roller means, with said first roller means comprising a first pair of laterally spaced apart rollers, means mounting said first and second roller means for rotation about respective axes, and including means for adjustably pivoting said first pair of rollers about a pivotal axis which is substantially perpendicular to the axes of rotation of said first pair of rollers, an endless belt entrained about said first and second roller means, and so as to define belt segments extending between the roller means and with the belt segments crossing in opposing face-to-face relation at a location between the roller means and so as to define a twisting zone therebetween, and with said belt segments directly engaging respective ones of said first pair of rollers, drive means operatively connected to at least one of said roller means for rotating the same, and such that said belt segments run in different directions through said twisting zone, means for guiding a running yarn through said twisting zone so as to have twist imparted thereto by frictional contact between the yarn and opposing belt segments, and whereby the belt segments may be separated at said twisting zone to facilitate yarn threadup by pivoting said first pair of rollers about said pivotal axis.

15. An apparatus for imparting twist to a running yarn and comprising first and second longitudinally spaced apart roller means, with said first roller means comprising a first pair of laterally spaced apart rollers, means mounting said first and second roller means for rotation about respective axes, and including a fixed support member, and a pair of brackets mounting respective ones of said first pair of rollers to said support member, and with said brackets being disposed on respective opposite sides of said first pair of rollers, an endless belt entrained about said first and second roller means, and so as to define belt segments crossing in opposing face-to-face relation at a location between the roller means and so as to define a twisting zone therebetween, and with said belt segments directly engaging respective ones of said first pair of rollers, drive means operatively connected to at least one of said roller means for rotating the same, and such that said belt segments run in different directions through said twisting zone, means for guiding a running yarn through said twisting zone so as to have twist imparted thereto by frictional contact between the yarn and opposing belt segments, and whereby a yarn may be threaded laterally between said first pair of rollers and to a position between said belt segments at said twisting zone.

* * * * *